United States Patent [19]

Robson

[11] Patent Number: 4,822,293

[45] Date of Patent: Apr. 18, 1989

[54] BELL HOUSING SEALING ASSEMBLY FOR MOUNTED CONNECTOR

[75] Inventor: Michael H. Robson, Pomona, Calif.

[73] Assignee: General Dynamics, Pomona Division, Pomona, Calif.

[21] Appl. No.: 123,416

[22] Filed: Nov. 20, 1987

[51] Int. Cl.[4] ..... H01R 13/73; H01R 13/52

[52] U.S. Cl. ..... 439/271; 439/559; 439/565

[58] Field of Search ..... 439/271, 272, 273, 519, 439/521, 544, 548, 556, 559, 565, 79

[56] References Cited

U.S. PATENT DOCUMENTS

| | | | |
|---|---|---|---|
| 1,285,677 | 7/1962 | Brevet | 122/360 |
| 3,104,120 | 9/1963 | Myers | 285/61 |
| 3,493,672 | 2/1970 | Bromberg | 174/78 |
| 3,549,177 | 12/1970 | Sotolongo | 266/170 |
| 3,739,076 | 6/1973 | Schwartz | 174/78 |
| 3,897,089 | 7/1975 | Leichsenring et al. | 285/158 |
| 3,994,553 | 11/1976 | Kornick | 439/79 |
| 4,090,029 | 5/1978 | Lundeberg | 174/51 |
| 4,224,464 | 9/1980 | Bunnell et al. | 174/65 R |
| 4,324,424 | 4/1982 | Woodliff et al. | 285/158 |

*Primary Examiner*—John D. Lee
*Assistant Examiner*—Phan T. Heartney
*Attorney, Agent, or Firm*—Neil F. Martin; Leo R. Carroll

[57] ABSTRACT

A sealing assembly for protecting the exposed components of a mounted electrical connector from the environment provides a seal between a connector backshell and a mounting plate to which the connector is mounted. The bell housing sealing assembly generally comprises a tubular member having a bottom end and a top end, the member being of sufficient inside diameter and length for surrounding an electrical connector having a backshell between the connector backshell and a mounting plate to which the connector is mounted; a top seal for sealing between the top end of the tubular member and the backshell of the surrounded connector; and a bottom seal for sealing between the bottom end of the tubular member and the mounting plate. The sealing assembly is threadably attached to either the connector backshell or, preferably, to the receptacle mounting nut. A second embodiment employs a force fit double lip seal as a top seal.

18 Claims, 2 Drawing Sheets

FIG. 1
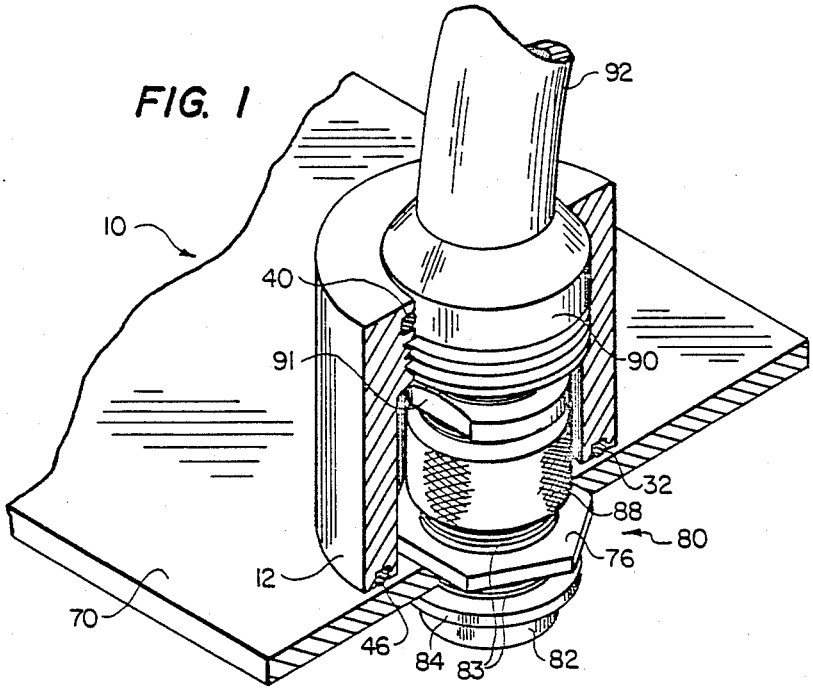
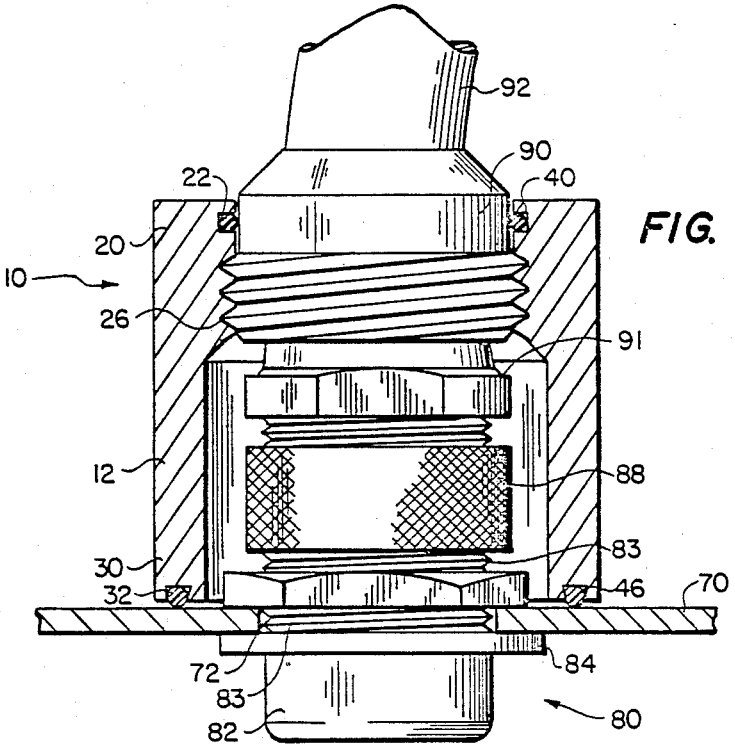
FIG. 2

FIG 3
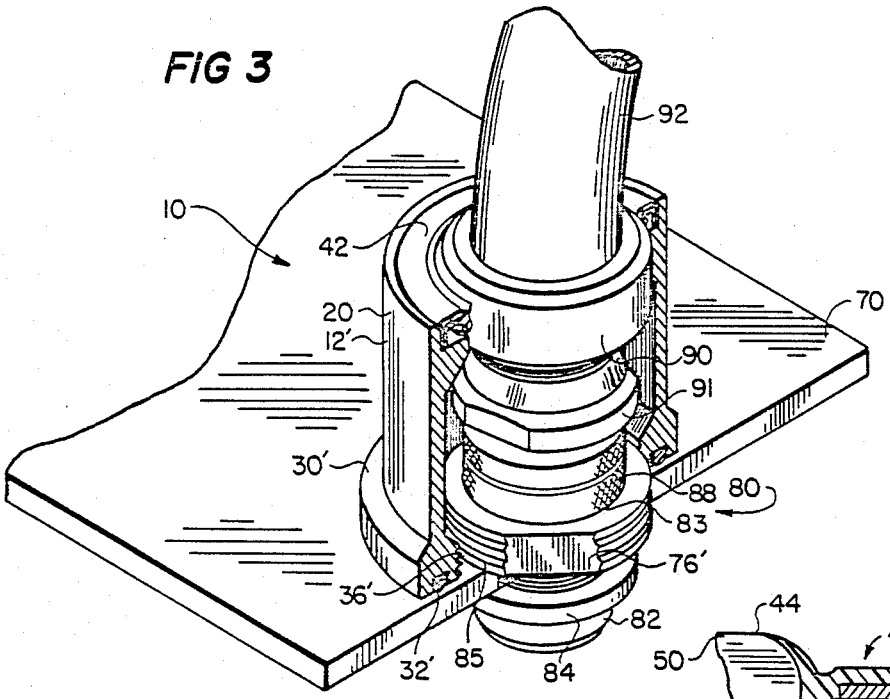
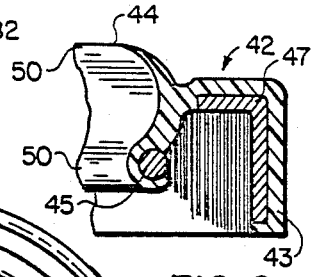
FIG. 6
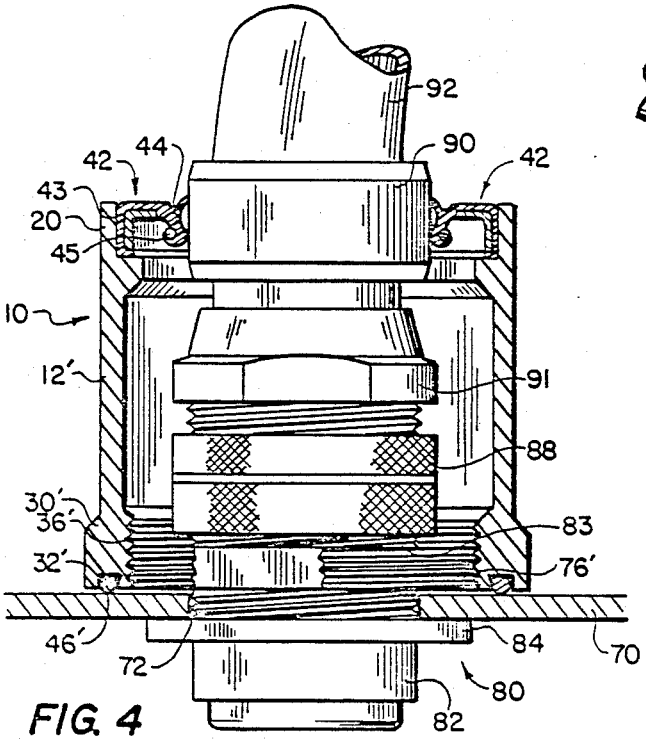
FIG. 4
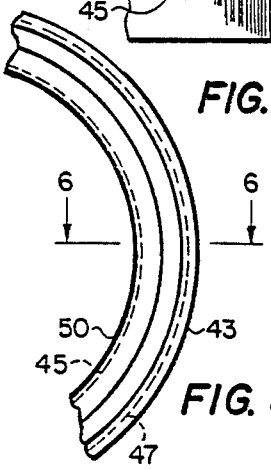
FIG. 5

BELL HOUSING SEALING ASSEMBLY FOR MOUNTED CONNECTOR

BACKGROUND OF THE INVENTION

1. Field of the Invention

This invention relates in general to environmental sealing enclosures for electrical connectors, and more specifically involves a sealing assembly for protecting the exposed components of a mounted connector from the environment.

2. Background of the Invention

Electrical and electronic equipment are connected to and interconnected with power and signal carriers. Typically, such carriers are in the form of wires. Due to servicing and installation requirements, the wires must have connectors which allow for relatively easy disconnection and reconnection. Connectors are particularly utilized for directly connecting wires to the electronic equipment.

In many situations, the wires must be protected from the environment. Typically, the wires are encased in a protective coating or housed in a protective conduit. However, it is much more difficult to protect the wires at the connector interface. Prior art sealed connectors are very specialized, and often include expensive materials. Such connectors are also complex and difficult to fabricate.

One attempt to avoid using such expensive, specialized connectors has been to utilize sealed junction boxes. A junction box is generally a box built around the connectors and sealed to the connectors or conduit. In use, junction boxes are bulky, awkward, and time consuming in connection and disconnection.

Therefore, it is desirable to have a device for quickly and easily protecting a mounted connector from the environment.

It is particularly desirable that such a device be easily adapted for use with connectors of various sizes and configurations.

SUMMARY OF THE INVENTION

This invention is a bell housing sealing assembly for protecting a mounted electrical connector from the environment by providing a seal between the connector backshell and the mounting plate.

The invention generally comprises: a tubular member having a bottom end and a top end; the member being of sufficient inside diameter and length for surrounding an electrical connector having a backshell between the connector backshell and a mounting plate to which the connector is mounted; attaching means for attaching the tubular member to the surrounded connector; a top seal for sealing between the top end of the tubular member and the backshell; and a bottom seal for sealing between the tubular member and the mounting plate. The top seal may be a resilient member such as a rubber O-ring. In the preferred embodiment, the top sealing member is a press fit double lip seal which provides a superior seal while reducing attachment friction and thereby aiding ease of connection. The bottom seal is a resilient member, such as a rubber O-ring. A channel on the bottom end of the tubular member holds the rubber O-ring in position. Preferably, the channel has a necked down portion for positively retaining the bottom seal.

In the exemplary embodiment, the sealing bell housing assembly attaches to the receptacle mounting nut.

Other features and many attendant advantages of the invention will become more apparent upon a reading of the following detailed description, together with the drawings, wherein like reference numerals refer to like parts throughout.

BRIEF DESCRIPTION OF THE DRAWING

FIG. 1 is a perspective view, partially cut away of mounted connector sealing assembly of the present invention.

FIG. 2 is a side view taken on line 2—2 of FIG. 1.

FIG. 3 is a perspective view, partially cut away, of a preferred embodiment of the mounted connector sealing assembly.

FIG. 4 is a side view taken on line 4—4 of FIG. 3.

FIG. 5 is a bottom view of an arc segment of the top seal of the embodiment of FIGS. 3 and 4.

FIG. 6 is a section view taken on line 6—6 of FIG. 5 of the top seal of FIGS. 3 and 4.

DETAILED DESCRIPTION OF THE INVENTION

With reference now to the drawing, there is shown two embodiments of the present invention as used in conjunction with a mounted electrical connector. With reference to FIG. 1, the sealing assembly of the present invention, designated generally as 10, is shown attached to a mounted connector, depicted generally as 80. Connector 80 is mounted on mounting plate 70, which is shown partially cut away in FIG. 1. Mounting plate 70 could be the outer wall of an electronic equipment package. Connector 80 is mounted through a hole 72 in the mounting plate 70.

The external components of a typical mounted connector 80 include: a connector receptacle 82 having a threaded end 83 for insertion into the mounting plate hole 72 and a flange 84, larger than the hole, for preventing the receptacle from passing through the hole; a mounting jam nut 76. having inside threads for engaging the threads on the threaded end 83 of receptacle 82 for securing the receptacle to the mounting plate; a connector plug 88 for attachment to the connector receptacle; and a connector backshell 90 for attachment to the connector plug. The connector backshell mounts onto the connector plug by use of the backshell nut 91. Protective conduit 92, enclosing and protecting the signal carriers in their run, is sealingly connected to connector backshell 90. The wires and their appropriate mating plug arrangements (not shown) are housed within these connective and protective elements.

Therefore, the exposed portion of a mounted connector, i.e. those components above the mounting plate in the drawing, includes a multiplicity of connector component interfaces which are potential leak sites for environmental fluids. There is a potential leaking area between the connector backshell nut 91 and the backshell 90, between the connector backshell nut 91 and the plug 88, between plug 88 and the threaded end 83 of the receptacle 82 and between receptacle 82 and the mounting plate 70.

By sealing between the connector backshell 90 and the mounting plate 70, the bell housing sealing assembly 10 eliminates all need for sealing structure and elements at the various connector component interfaces.

The sealing bell housing assembly 10 includes a generally tubular member 12. Tubular member 12 includes a top end 20 and a bottom end 30; top sealing means, such as top rubber O-ring 40; and bottom sealing means, such as bottom O-ring 46. In the embodiment of the invention shown in FIGS. 1 and 2, top end 20 of tubular member 12 includes attaching means, such as threads 26 for attaching the bell housing sealing assembly 20 to the connector 80. Threads 26 engage with threads on the connector backshell 90.

In use, the bell housing sealing assembly 10 is positioned to first surround the conduit 92. This may be accomplished either in preassembly of the conduit and connector backshell, or by threading the assembly 10 over the connector backshell prior to connection of the connector components. After connection of the connector backshell 90 to the mounted components 88, 76, 82 of the connector, the bell housing sealing assembly 10 is slid to surround the connector, threads 26 are mated with the connector backshell 90, and the sealing assembly 10 is threaded on until bottom O-ring 46 forms a seal between mounting plate 70 and the bottom end 30 tubular member 12 and until top O-ring 40 seals between the connector backshell 90 and the top end 20 of tubular member 12. In this manner, the exposed, unsealed portion of the connector is protected from the environment.

It is seen that the inside dimensions of tubular member 12 must be sufficient to fit over and surround the members of connector 80 which are exposed above the mounting plate. Also tubular member 12 must be of sufficient length to seal between the connector backshell 90 and the mounting plate 70. Top end 20 of tubular member 12 includes top seal retention means, such as to continuous channel 22. The bottom end 30 of tubular member 12 includes a bottom seal retaining means, such as bottom continuous channel 32.

The top and bottom seals may be of any appropriate resilient material. In certain applications, common rubber O-rings will be sufficient.

FIGS. 3 and 4 illustrate an exemplary embodiment of the bell housing sealing assembly 10 of the present invention. This embodiment includes several advantages over the first described embodiment. In FIGS. 3 and 4, tubular member 12' includes attaching means, such as threaded portion 36' on the inside of the bottom end 30 for mating with the threaded outside portion of a connector mounting nut 76'.

The bottom end 30' of tubular member 12' includes bottom seal retention means, such as channel 32'. Channel 32' includes an outer necked down portion for retaining a resilient seal, such as rubber O-ring 46', within the channel once it is pressed into the channel 32' past the restricted portion. In the exemplary embodiment, the bottom channel 32' is dove-tailed in cross section and the restricted portion is disposed immediately at the entrance to the channel.

The top sealing means for sealing between the top end of the tubular member and the backshell of the surrounded connector is a double lip seal 42. FIGS. 5 and 6 illustrate double lip seal 42 in greater detail. FIG. 5 is a bottom view of a segment of the double lip seal ring and FIG. 6 is an enlarged sectional view taken on line 6—6 of FIG. 5. Double lip seals of this type are commercially available and include an outside diameter portion 43 of which the outside covering is of resilient sealing material and which generally contains a flexible metal stiffener. The outside diameter portion 43 of double lip seal 42 is force fit or press fit into the upper inside diameter of tubular member 12'. The inside diameter portion 44 includes two sealing lips for sealing against the connector backshell. A metal stiffening spring 45 holds the base of the double lips against the connector backshell 90. The double lip seal 42 provides a superior seal while reducing assembly friction which in turn eases mating.

The bell housing sealing assembly described eliminates the need to use specialized connectors or expensive materials in fabricating connectors. Standard, inexpensive connectors can be used for most applications and the bell housing sealing assembly can be simply added to those connectors which require protection from the environment.

The bell housing sealing assembly is only slightly larger than the surrounded connector and requires only about 35% more surface area on the mounting plate. The bell housing sealing assembly is small, easy to manufacture, and requires no special tools for attachment. Once the sealing assembly is attached to a connector and conduit, it will remain captivated either in the sealing position or in the retracted position surrounding the conduit. Thus, it will not be lost and will not easily be damaged. The seals are replaceable.

The bell housing sealing assembly of the present invention can be applied to many sizes and shapes of connectors; rectangular, coaxial, square and circular. It can assume a variety of shapes dependent on the applications, connector size and shape, and type of harnessing, conduits and backshells.

From the foregoing description, it is seen that the present invention provides an extremely simple, efficient and reliable manner of sealing a mounted connector from its environment while providing easy access to the protected connector for inspection, maintenance, or disassembly for replacement.

As various changes may be made in the form, construction, and arrangement of the parts herein, without departing from the spirit and scope of the invention, and without sacrificing any of its advantages, it is to be understood that all matter herein is to be interpreted as illustrative and not in any limiting sense, and it is intended to cover in the appended claims such modifications and changes as come within the true spirit and scope of the inventions.

I claim:

1. A sealing bell housing for enclosing part of an electrical connector mounted on a mounting plate and projecting through an opening in the mounting plate, said housing comprising:

a tubular member having a bottom end and a top end; the bottom end having an end face directed axially away from the tubular member, said member having a predetermined inside diameter and length for surrounding part of an electrical connector projecting through an opening in a mounting plate to which the connector is mounted;

attaching means for attaching said tubular member to the surrounded connector;

top sealing means for sealing between said top end of said tubular member and the end of a surrounded connector;

said tubular member having a predetermined axial length between said top sealing means and said bottom end no greater than the length of the projecting part of said electrical connector; and bottom sealing means on said bottom end face for sealing between said bottom end face of said tubular member and the opposing outer face of a mounting plate to which a surrounded connector is mounted.

2. The sealing bell housing of claim 1 wherein;

said bottom sealing means includes a resilient seal; and said bottom end of said tubular member includes bottom seal retention means for retaining said bottom resilient seal.

3. The sealing bell housing of claim 2 wherein said bottom seal retention means includes a continuous channel in said bottom end for retaining said bottom resilient seal.

4. The sealing bell housing of claim 3 wherein said continuous channel in cross section includes a necked-down portion for retaining said bottom resilient seal within said channel.

5. The sealing bell housing of claim 4 wherein said continuous channel is dove-tail in cross section.

6. The bell housing of claim 1 wherein said top sealing means includes a top resilient seal; and retention means for retaining said top resilient seal.

7. The sealing bell housing of claim 6 wherein said top seal retention means includes a top continuous channel for retaining said top resilient seal.

8. The sealing bell housing in claim 6 wherein said top resilient seal is a double lip seal.

9. The sealing bell housing of claim 1 wherein said tubular member attaching means comprises means for attaching the bottom end of said tubular member to a mounting nut of a surrounded connector adjacent the mounting plate.

10. The sealing bell housing of claim 9 wherein;

said bottom sealing means includes a resilient seal; and said bottom end of said tubular member includes bottom seal retention means for retaining said bottom resilient seal.

11. The sealing bell housing of claim 10 wherein said bottom seal retention means includes a continuous channel in said bottom end for retaining said bottom resilient seal.

12. The sealing bell housing of claim 11 wherein said continuous channel in cross section includes a necked down portion for retaining said bottom resilient seal within said channel.

13. The sealing bell housing of claim 12 wherein said continuous channel is dove-tail in cross section.

14. The bell housing of claim 9 wherein said top sealing means includes a top resilient seal; and said top end of said tubular member includes top seal retention means for retaining said top resilient seal.

15. The sealing bell housing in claim 9 wherein said top sealing means includes a resilient double lip seal, the double lips for sealing against the connector backshell.

16. The sealing bell housing of claim 1 wherein said tubular member attaching means comprises means for attaching the top end of said tubular member to the backshell of a surrounded connector.

17. The sealing bell housing of claim 16 wherein said attaching means includes threads on said top end of said tubular member for engaging external threads on the connector backshell.

18. The sealing bell housing of claim 1, wherein said tubular member has a predetermined axial length substantially equal to the length of the projecting part of said electrical connector.

* * * * *